US005772522A

United States Patent [19]

Nesbit et al.

[11] Patent Number: 5,772,522

[45] Date of Patent: Jun. 30, 1998

[54] METHOD OF AND SYSTEM FOR ANALYZING A GOLF CLUB SWING

[75] Inventors: Steven M. Nesbit, Easton, Pa.; Terry A. Hartzell, Madison, Wis.; Keith A. Oglesby, Farmington Hills, Mich.; Jeff Cole, Whitehouse Station; Anthony F. Radich, Somerville, both of N.J.

[73] Assignee: United States of Golf Association, Far Hills, N.J.

[21] Appl. No.: 344,725

[22] Filed: Nov. 23, 1994

[51] Int. Cl.[6] ..... A63B 69/36

[52] U.S. Cl. ..... 473/222; 473/266; 473/409; 434/252

[58] Field of Search ..... 273/183, 186.1, 273/26 R, 29 A; 434/252, 256, 257; 473/207, 222, 266, 267, 409, 140

[56] References Cited

U.S. PATENT DOCUMENTS

| | | | |
|---|---|---|---|
| 4,137,566 | 1/1979 | Haas et al. | 273/186.1 |
| 4,891,748 | 1/1990 | Mann | 273/183.1 |
| 5,111,410 | 5/1992 | Nakayama et al. | 273/183.1 |

OTHER PUBLICATIONS

Daniel Ruby, "Biomechanics", Popular Science, Jan. 1982, pp. 58–60.

*Primary Examiner*—Jessica Harrison
*Assistant Examiner*—James Schaaf
*Attorney, Agent, or Firm*—McAulay Fisher Nissen Goldberg & Kiel, LLP

[57] ABSTRACT

A method of and system for analyzing golf swings is described. A three dimensional android computer model of a human as well as a parametric dynamic computer model of a golf club are generated and combined. In addition, the three dimensional motions of a person swinging a golf club are recorded using cameras that track reflective markers placed at various locations on the person. A computer processes the marker path data to calculate three dimensional angular motions of the body segments of the person and the golf club which is then used to kinematically drive the joints of the android model to effect superposition of the recorded golf swing on the android model and golf club model. Kinetic data derived from the analysis of the model may in turn be used to dynamically drive the joints of the android model to also superimpose the recorded swing on the models. The results are used, among other things, to study the biomechanics of the golfer and the performance of the golf club.

12 Claims, 14 Drawing Sheets

Figure 1:
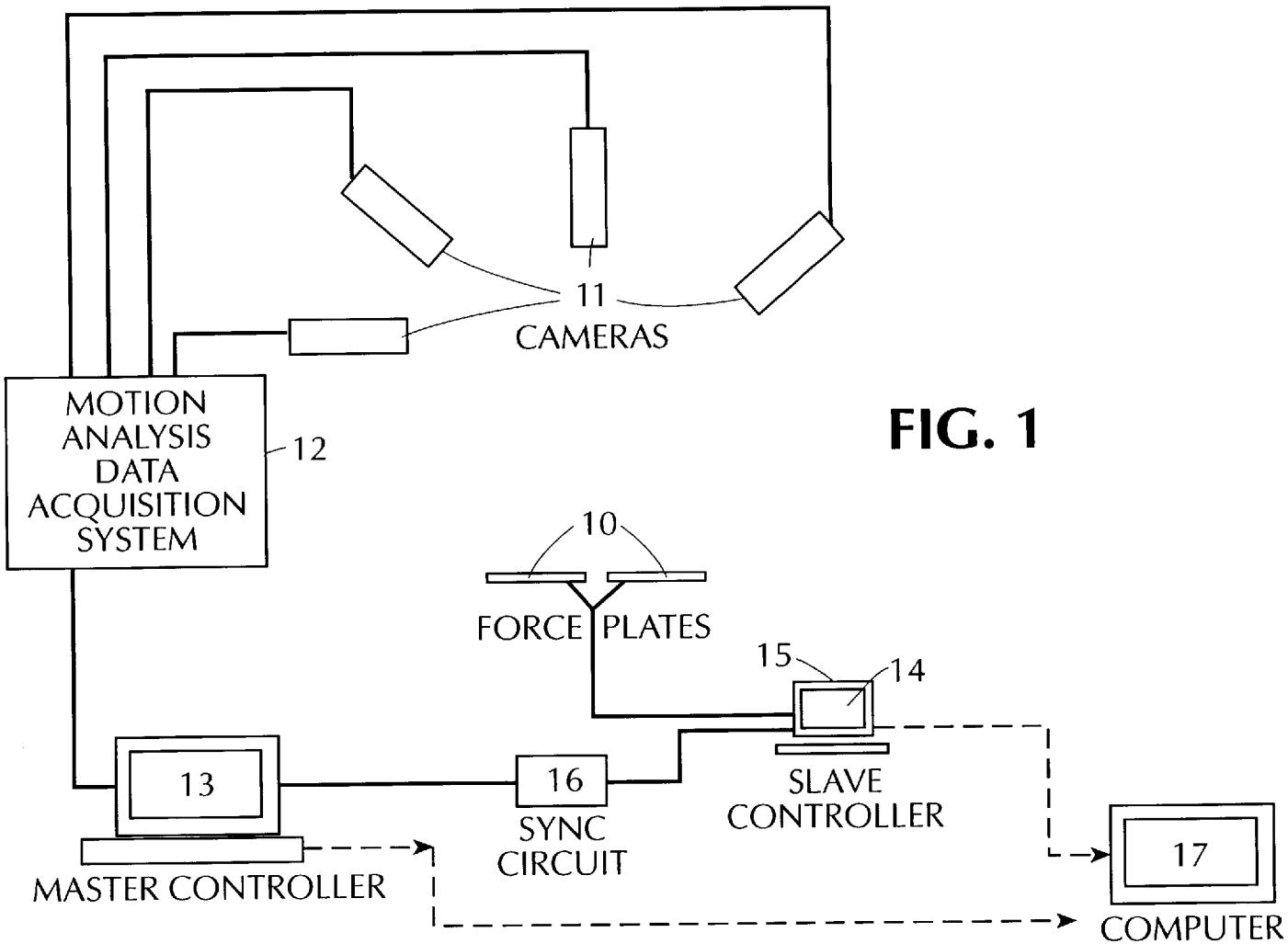

FIG. 12
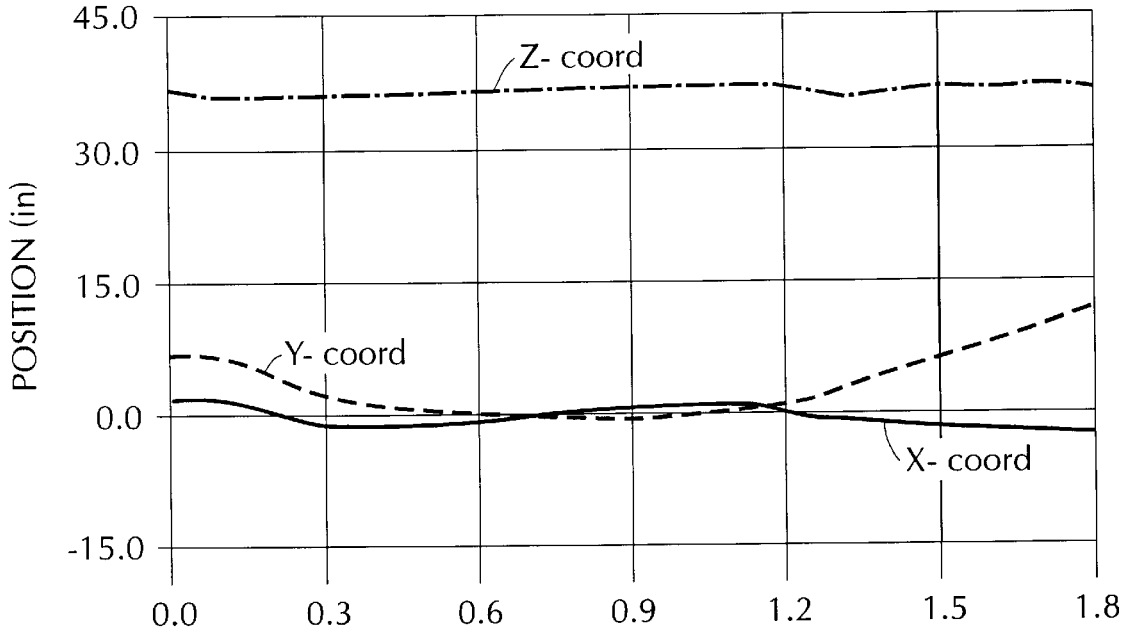
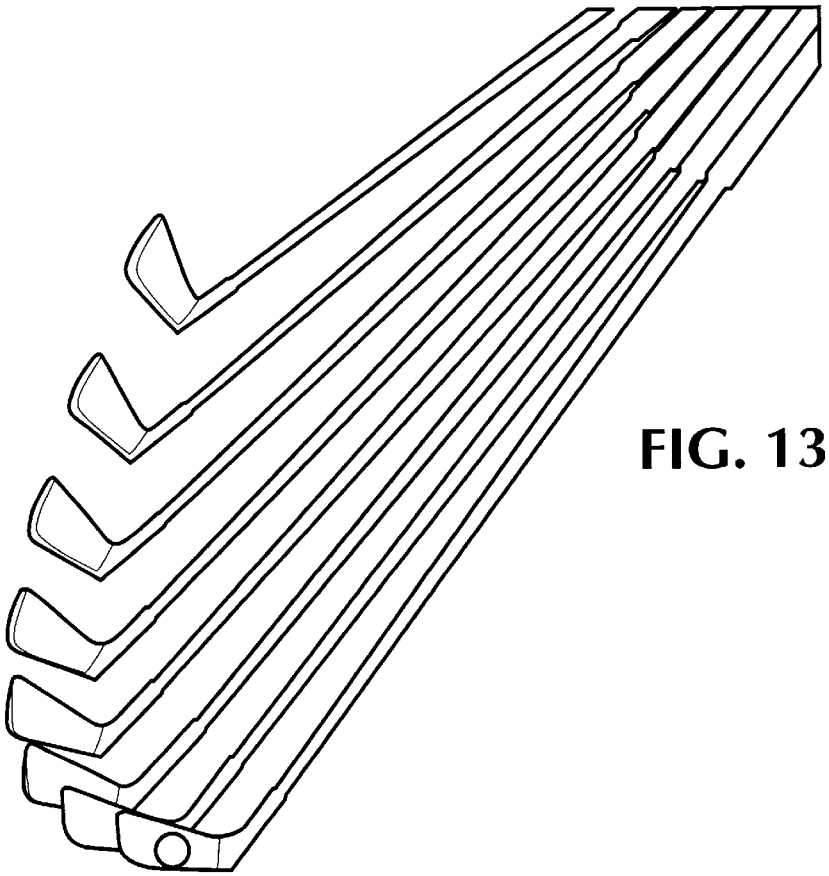
FIG. 13

METHOD OF AND SYSTEM FOR ANALYZING A GOLF CLUB SWING

This invention relates to a method of and system for simulating and analyzing a golf club swing. More particularly, this invention relates to a method and system for simulating and analyzing a motion of an active body coupled with an implement.

As is known, various empirical techniques have been employed to develop a consistency, efficiency, and power in the swing of a golfer, baseball player, softball player, tennis player and the like. These techniques have been based upon kinematic parameters which indicate that a consistent, efficient, and powerful swing will achieve a maximum effect on the ball or object to be driven.

Other techniques have also been developed to computer simulate the movement of an active person such as a runner, golfer, baseball player and the like. Typically, these techniques have been employed in order to study the kinematic motion of the person and apply empirical techniques in order to achieve optimum results for the desired activity.

Because these techniques are generally limited to kinematic analysis, it has been impossible to comprehensively study the biomechanics of a golfer and the biomechanical effects that equipment may have on the golfer's swing.

Accordingly, it is an object of the invention to create a kinematically and dynamically representative computer model of a golfer and golf swing to obtain an unbiased biomechanical and analytical prospective of a golfer and a golfer's swing.

It is another object of this invention to graphically simulate a golfer's swing.

It is another object of this invention to determine the kinematics and kinetics of each joint and segment of a golfer's body in producing a golf shot.

It is another object of this invention to determine the interactions between a golfer and the ground during a swing.

It is another object of the invention to be able to study the interactions between a golfer and his/her equipment.

It is another object of the invention to be able to investigate the motions and dynamic behavior of a golf club.

It is another object of this invention to determine the path of the mass center of a golfer's body during a swing.

It is another object of this invention to determine the effect of an impact on a golfer's body and the dynamic behavior of a golf club.

It is another object of the invention to accurately study the effects of equipment on a golfer.

It is another object of the invention to be able to quickly and easily determine the effect of new equipment on a user.

Briefly, the invention provides a method of and system for simulating and analyzing a motion of an active body with an implement, for example, the golf swing of a golfer with a golf club.

The method as applied to the analysis of a golf swing comprises a step of generating a three-dimensional android computer model having rigid segments with size, mass, and inertia characteristics representative of a person and spherical joints interconnecting the rigid segments. The characteristics which are used are selected from the group consisting of gender, body weight, and overall height. This android computer model is generated, for example, using a commercial software package ADAMS/ANDROID, which produces a three-dimensional mechanism made up of fifteen rigid segments with mass and inertia properties interconnected by fourteen spherical joints that can be constrained or driven by separate motions and/or forces.

In addition, the method includes the steps of generating a parametric dynamic computer model of a golf club representative of a golf club to be swung by a person and of combining the android model with the golf club model and a ground surface and an impact model (optional) to obtain a complete model.

Once the complete model has been computer-generated, the motion of a person, e.g. a golfer, can be recorded and applied to the complete model to have the model simulate the motion, e.g. a golf swing. In this respect, the motion of the golfer is recorded and processed in three dimensions during the swing of a golf club to obtain data characteristic of the swing. For example, a plurality of markers e.g. optically reflective markers, are placed on the golfer, e.g. at various joints, while a triad of markers is placed on a shaft of the golf club to be swung by the golfer. The triad of markers on the golf club shaft serve to define a plane for purposes which will become apparent in the following. In addition, the motions of the markers on the person and on the club head shaft are recorded, as by a plurality of cameras, and the recorded motions are processed to yield three dimensional marker path data characteristic of the golf swing.

In accordance with the method, the marker path data is processed to calculate three-dimensional angular motions for the android model segments and the dynamic golf club model corresponding to the marker path data. Thereafter, the joints of the android model are kinematically driven in dependence on the three-dimensional angular motions to effect superposition of the golf swing on the android model and the golf club model. This serves to simulate the actual golf swing on the android model.

A torque control function may also be superimposed on the kinematically driven android model in order to maintain both feet of the android model on the ground surface in dependence on the recorded ground reaction forces.

Having the golfer's swing simulated by the android, the forces and torques produced in the joints of the android by the swing can then be determined. As the android simulates the golfer, so also does the determined forces and torques indicate the forces and torques in the joints of the golfer. Thus, from a training standpoint, if a joint is determined to be overstressed, the golfer can be trained to change his/her swing or can be trained to strengthen the joint in question to accommodate the stress. Also, from an equipment standpoint, the club may be changed to a club which reduces the stress at an indicated joint.

Likewise, the torques determined by the analysis of the kinematically driven android model can be used to drive the joints of the android. If all aspects of the android and golf club model remain constant, then by Newton's Second Law, the original simulated swing is reproduced. For a kinetically driven android simulating a golf swing, so also does the determined motions indicate the motions of the joints of the golfer. Thus, from an equipment standpoint, changes in the dynamic characteristics of the golf club can be investigated as to their effects on the outcome of the swing. Therefore, clubs can be designed to change or augment some aspect of a golfer's swing.

The system for analyzing a golf swing includes a means for generating the three-dimensional android model, a means for generating the parametric dynamic model of the golf club, and a means for combining the android model with the golf club model and a ground surface and an optional impact model. In addition, the system employs a means for recording and processing the motion of a person in three dimensions during swinging of a golf club to obtain data characteristic of the swing. This latter means may include a plurality of markers for mounting on a plurality of positions on the person, a triad of markers on the golf club shaft and a plurality of cameras directed toward the person from a plurality of different angles for recording the motion of the markers as during a golf swing. This means also includes a data acquisition system connected to each camera to receive information therefrom corresponding to the motion of the markers as well as a computer connected to the data acquisition system to receive and process the information to obtain data characteristic of the swing.

The system also includes a second computer for processing the data from the computer connected to the data acquisition system. This second computer serves to process the data in order to calculate the three-dimensional angular motions for the android model segments and the golf club model. The second computer also has a means for kinematically driving the joints of the android model in dependence on the angular motions in order to simulate the actual golf swing. It also has a means for extracting the joint torques determined from the analysis of the android model driven with joint motions and using these to kinetically drive the joints of the android model to likewise simulate a golfer's swing.

A force plate data acquisition system is also employed to measure the vertical reaction forces of the person swinging the golf club and particularly the forces between the feet of the golfer and the ground. In this respect, at least one of the height, weight and gender of the person is also recorded.

In accordance with the invention, a computer model of a golf swing is developed by combining the android model and the club model with a ground model and optional impact model to study the biomechanics of the golfer and golf swing, the interactions between the golfer and his clubs and the ground, the performance of the club during a swing, and the club's and golfer's response to impact. For example, the computer model uses the software packages ADAMS (Mechanical Dynamics, Inc., Ver 7.0) to model the golf club, the ground surface, and the impact, and ADAMS/ANDROID (Mechanical Dynamics, Inc., Ver. 1.0) to model the golfer, and ADAMS to solve the resulting complete golf swing model. Data to drive the model is obtained from a four camera motion analysis system (available from Motion Analysis Corp.). Coordination of the model components and the swing data is performed with FORTRAN and BASIC programs.

The model is kinematically verified with the motion analysis system and kinetically verified with the force plate data acquisition system. The resulting model simulates a golfer's swing and is analyzed to study the biomechanics of a golfer and his swing and the effects of changing golf club parameters on both the golfer and his swing.

The process of collecting data, creating the computer model, and solving and analyzing the model is a complex set of steps performed with data acquisition systems and computer programs.

Figure 2:
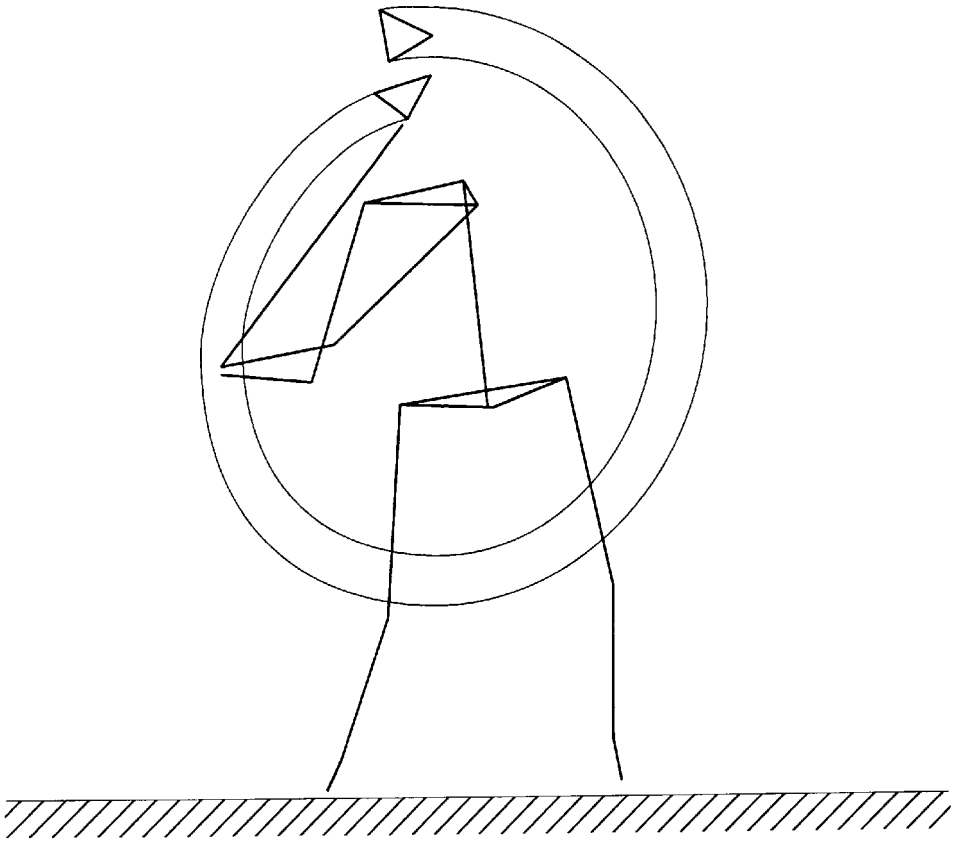

These and other objects and advantages of the invention will become more apparent from the following description taken in conjunction with the accompanying drawings wherein:

FIG. 1 schematically illustrates a data acquisition system for recording golf swings in accordance with the invention;

FIG. 2 graphically illustrates a computer generated display of the motions of a golf swing from the motion analysis system.

Figure 3:
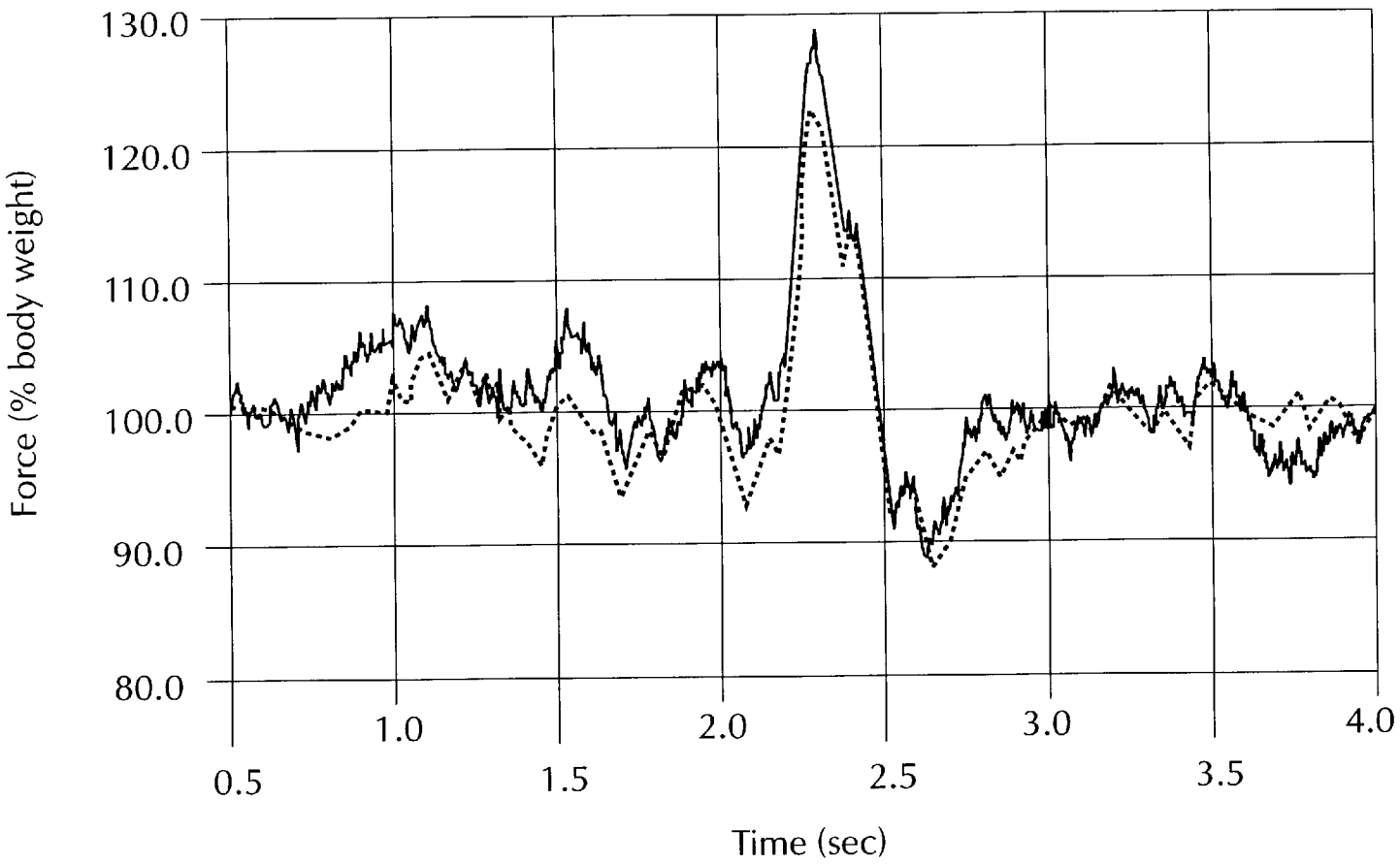
Figure 4:
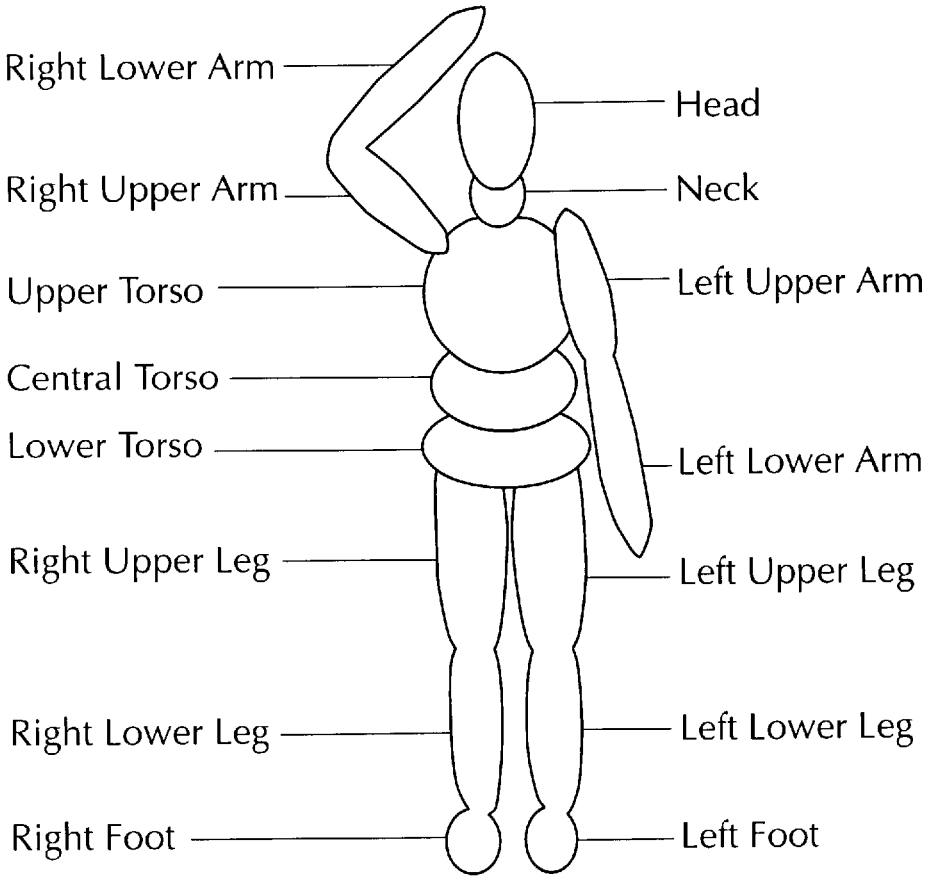
Figure 5:
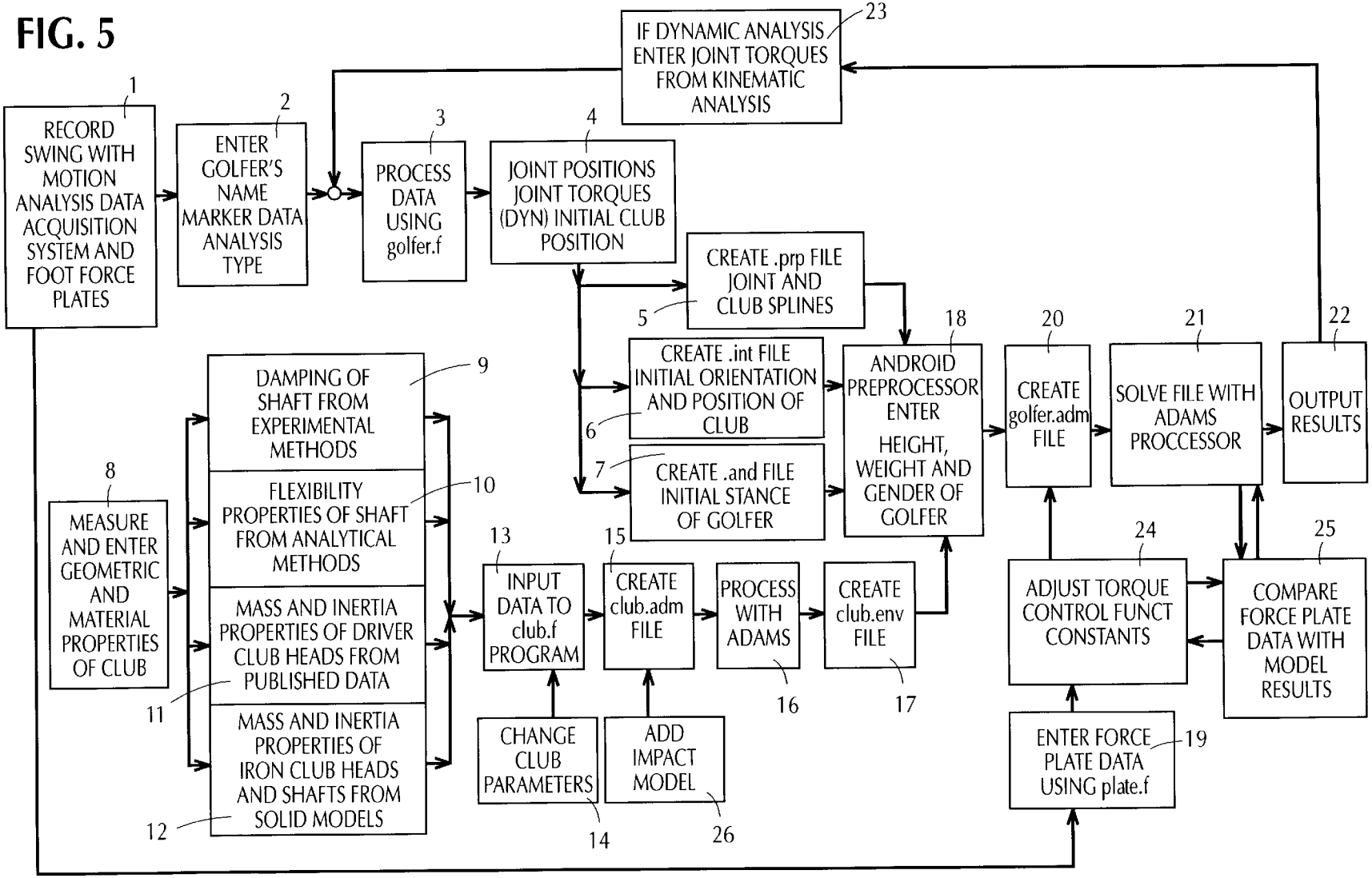
Figure 6A:
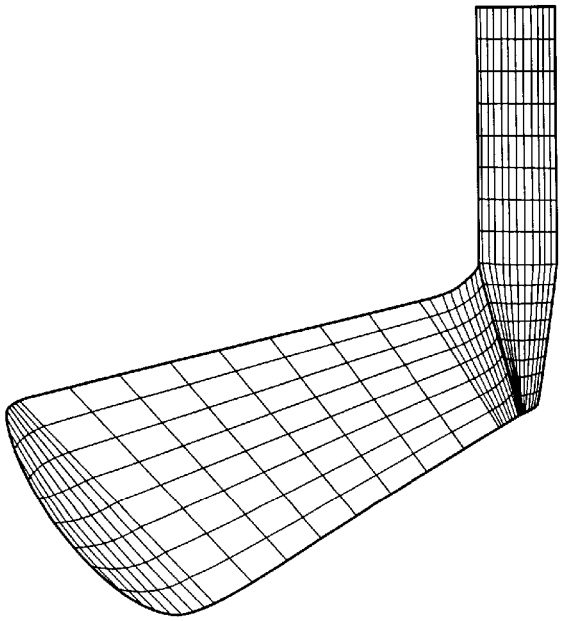
Figure 6B:
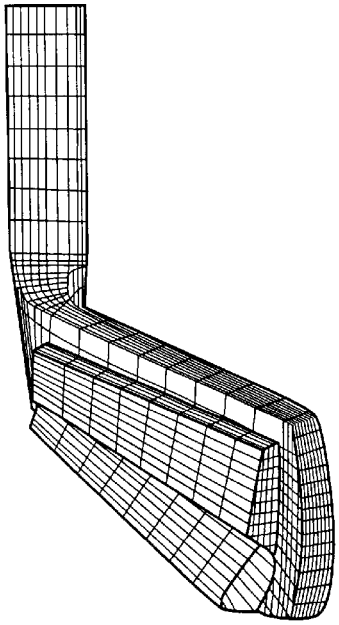

FIG. 3 graphically illustrates the ground reaction forces on the feet of a golfer during a golf swing both measured by the force plate data acquisition system and determined by the analysis of the model;

FIG. 4 illustrates an android with segment identification;

FIG. 5 schematically illustrates an algorithm for the creation of a computer model of a golf swing in accordance with the invention;

FIG. 6*a* illustrates a front view of a solid model representation of an iron golf club head used to determine its mass properties in accordance with the invention;

FIG. 6*b* illustrates a rear view of the solid line of representation of FIG. 6*a;*

Figure 7A:
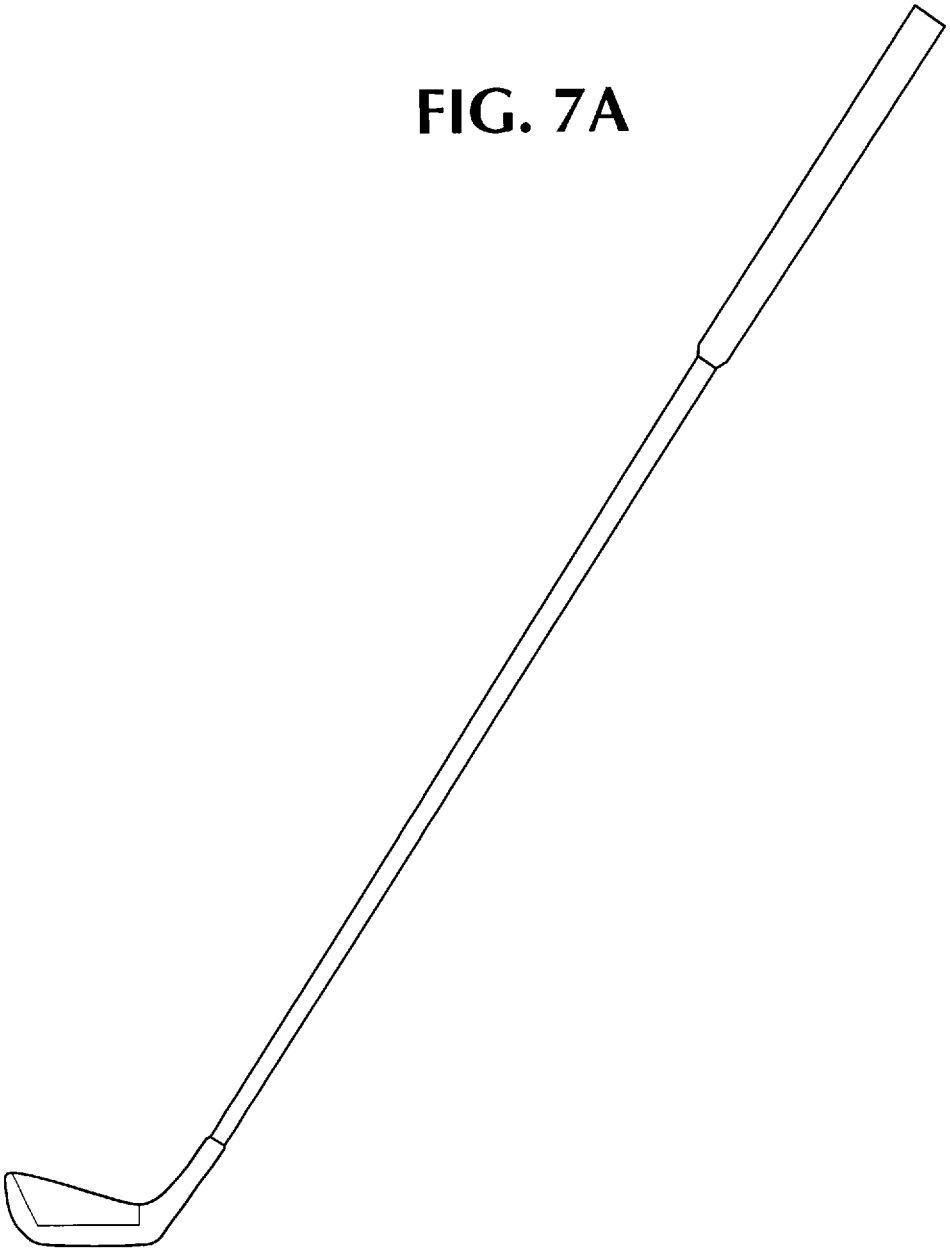
Figure 7B:
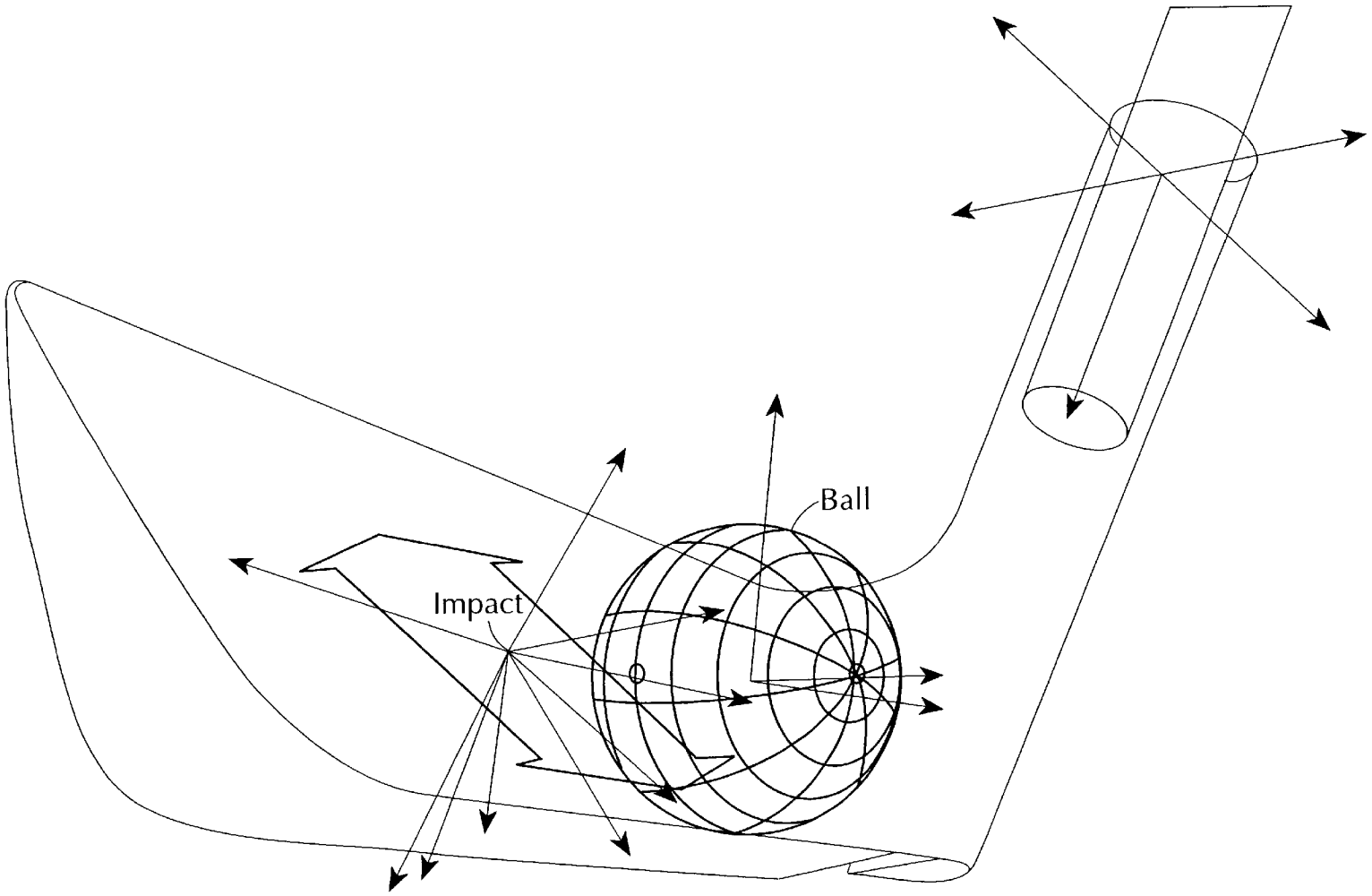
Figure 8:
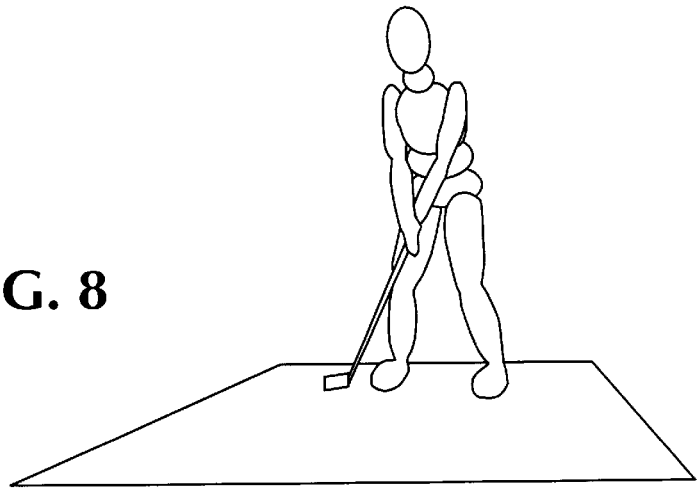
Figure 9A:
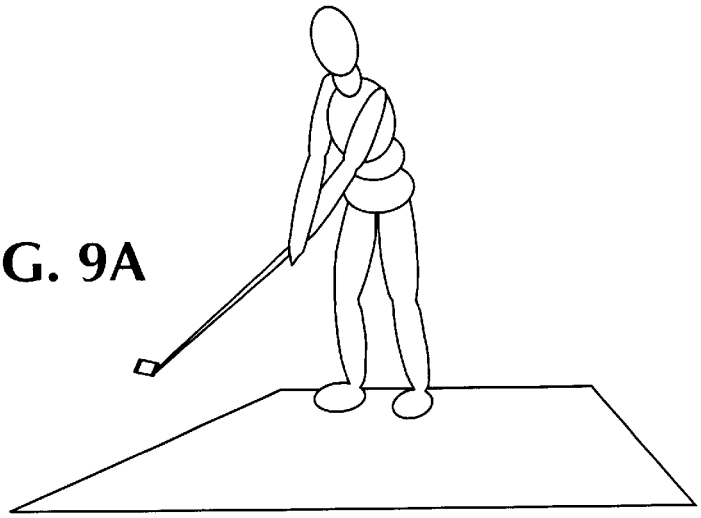
Figure 9B:
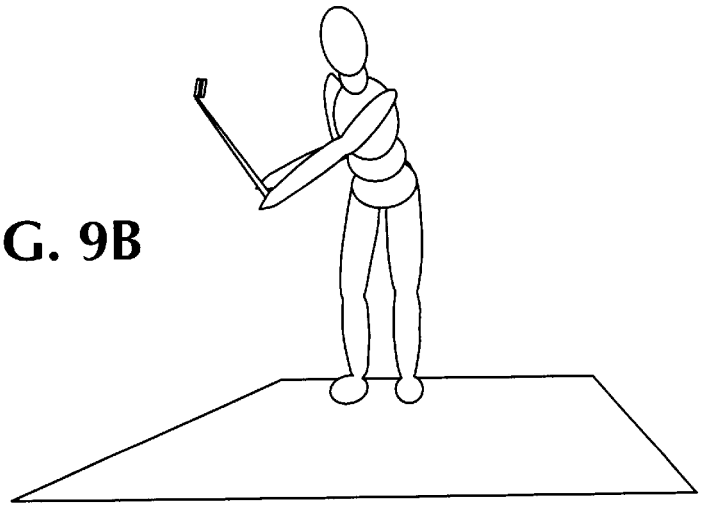
Figure 9D:
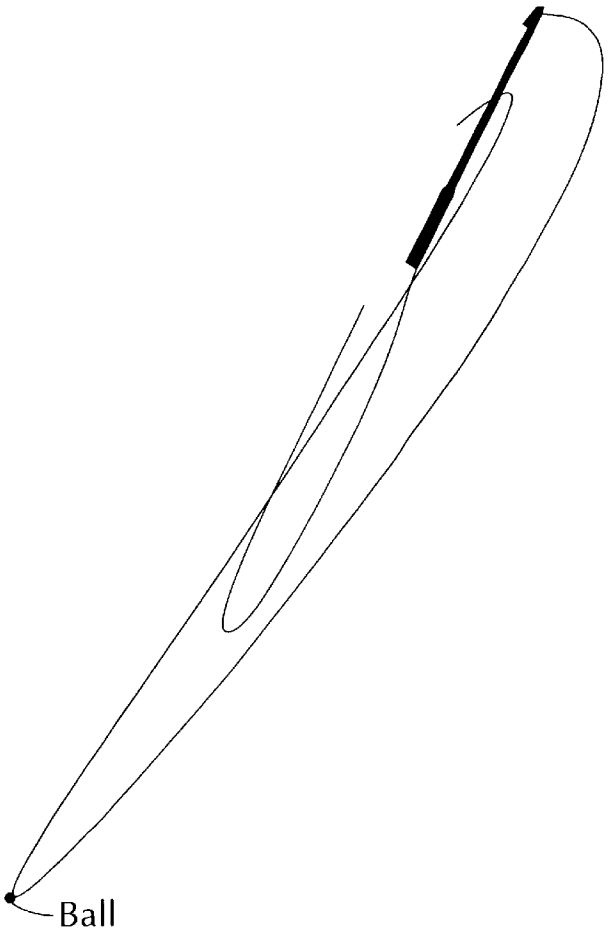
Figure 9C:
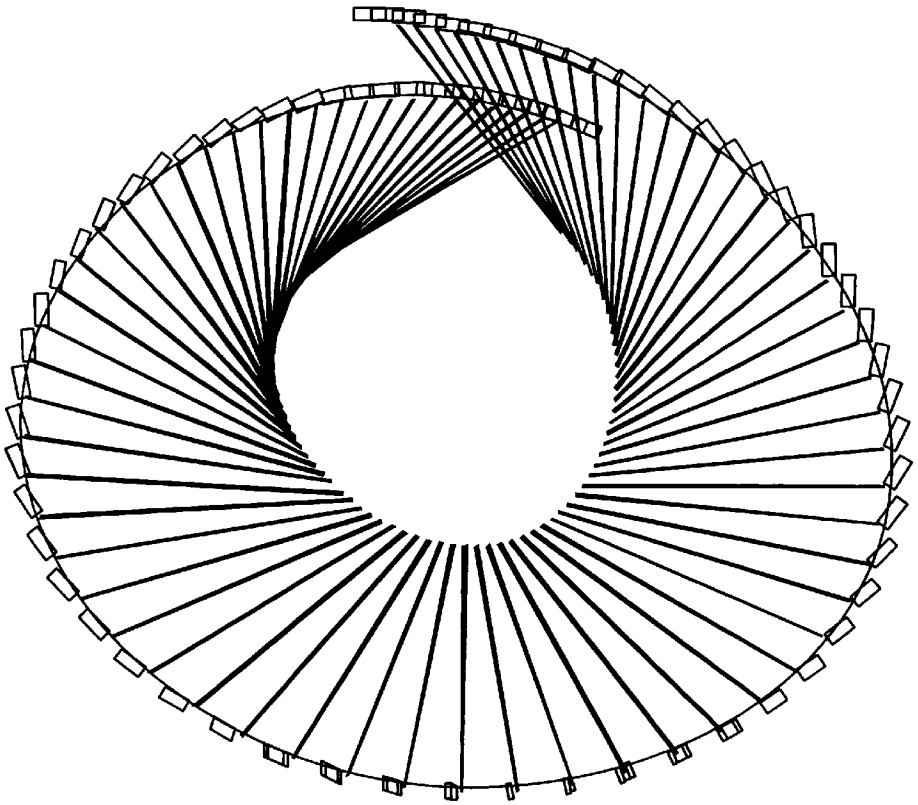
Figure 10A:
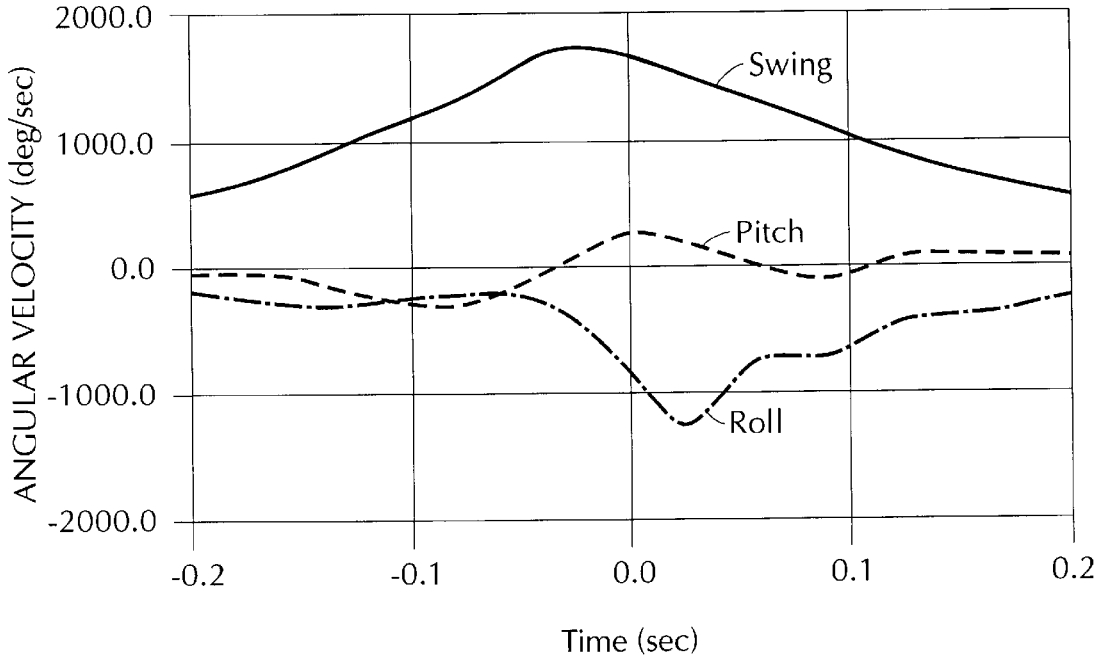
Figure 10B:
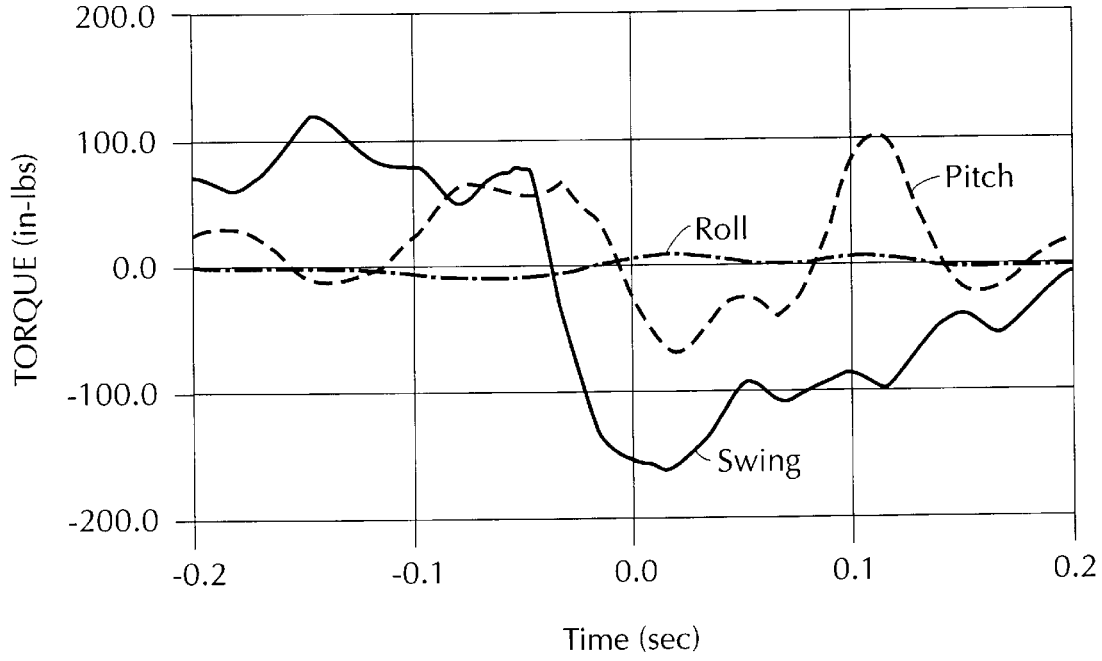
Figure 11A:
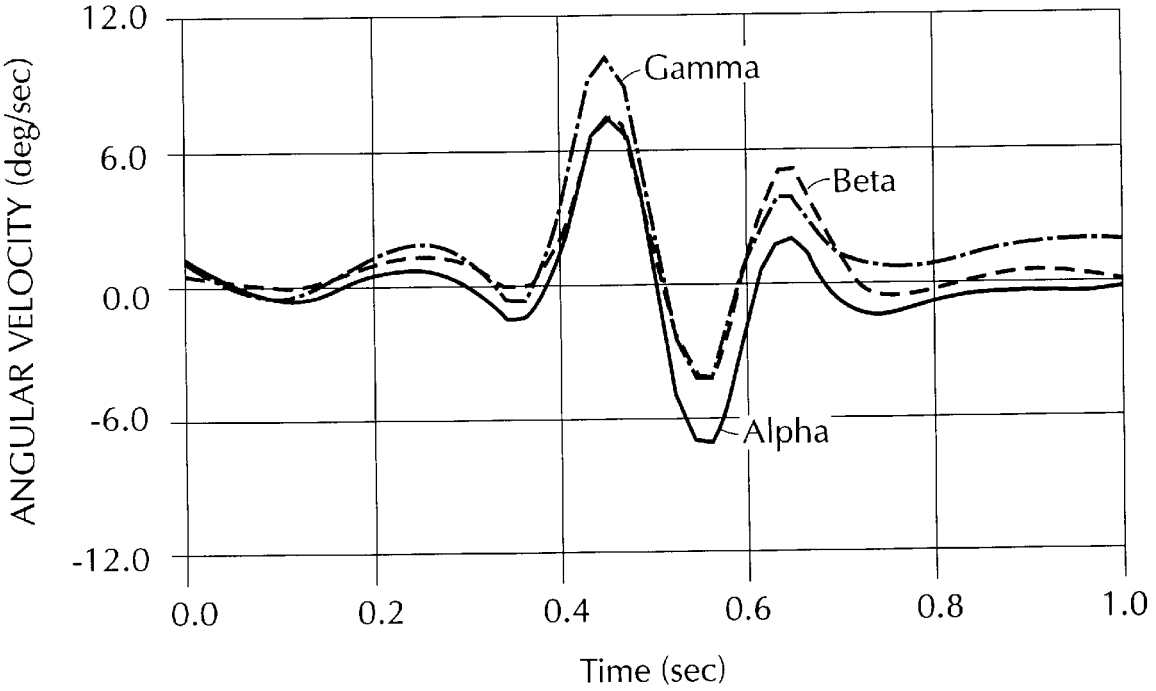
Figure 11B:
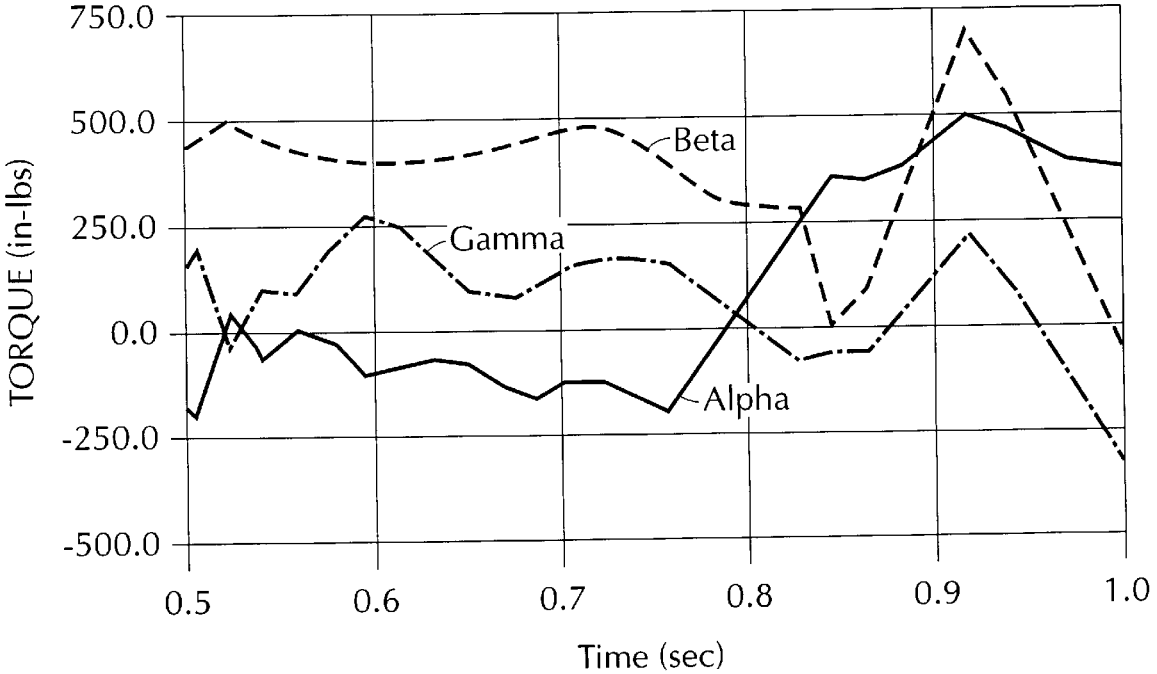
Figure 14:
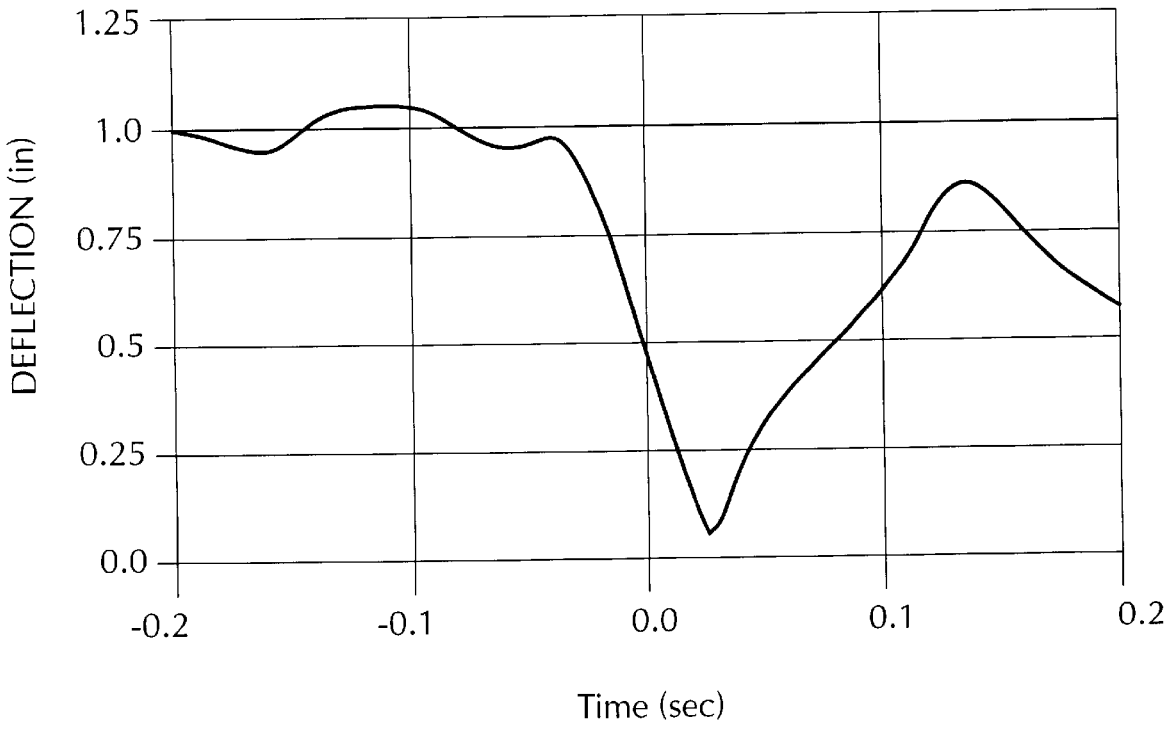
Figure 15:
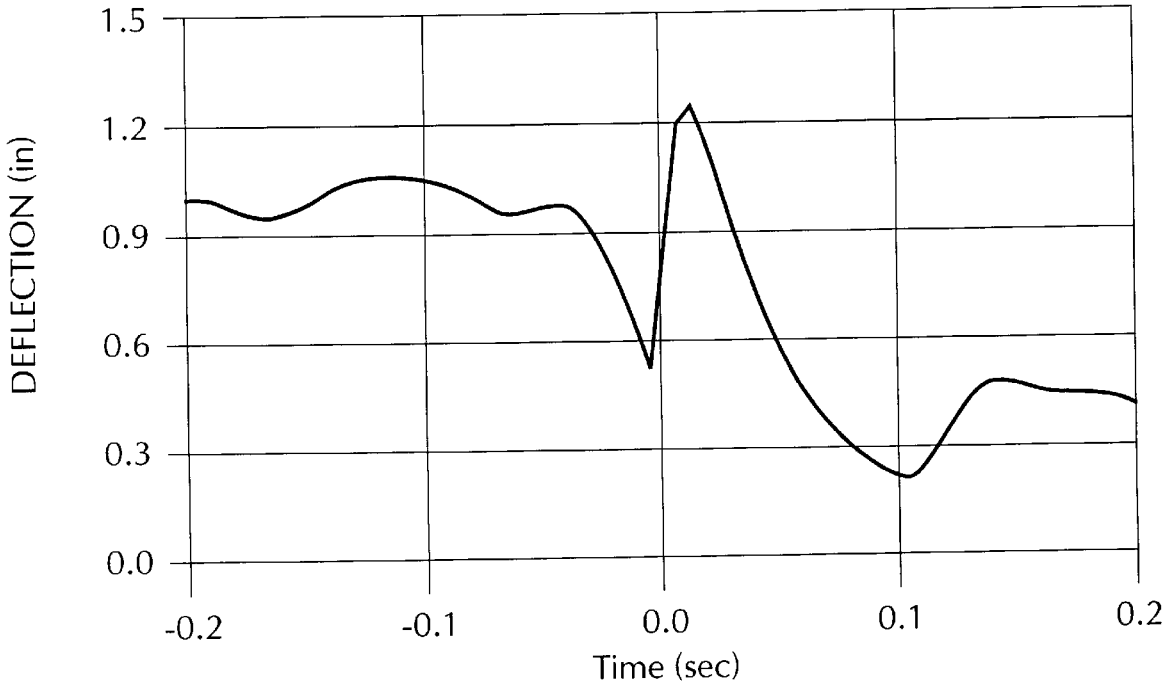

FIG. 7*a* illustrates a model of a golf club which is computer generated and contains all its important properties;

FIG. 7*b* graphically illustrates an impact model between a club head and a ball model;

FIG. 8 illustrates a complete computer generated golfer model in accordance with the invention;

FIG. 9*a* graphically illustrates a simulated golf swing at the beginning of the backswing;

FIG. 9*b* graphically illustrates a simulated golf swing at mid point in downswing;

FIG. 9*c* graphically illustrates a simulated golf swing which is a superimposed front view showing the path of the club head with the android graphics removed for clarity;

FIG. 9*d* graphically illustrates a side view of a simulated golf swing showing the path of the club head with the android graphics removed for clarity;

FIG. 10*a* illustrates the angular velocity kinematics of the golf club during a swing;

FIG. 10*b* illustrates the torque kinetics of interaction between the golfer and the golf club during a swing;

FIG. 11*a* illustrates the angular velocity kinematics of a joint of the android model;

FIG. 11*b* illustrates the torque kinetics of a joint of the android model;

FIG. 12 illustrates the path of the mass center of the golfer during a swing;

FIG. 13 graphically illustrates the position and orientation of the club head;

FIG. 14 illustrates the deflection of the club head during the golf swing; and FIG. 15 illustrates the club head deflection caused by the swinging of the club and impact with the ball.

Referring to FIG. 1, the system for analyzing a golf club swing of an individual employs means for recording and processing the motion of a person in three dimensions during swinging of a golf club to obtain data characteristic of the swing. For example, this recording and processing means includes a plurality of markers (not shown) which are mounted at a plurality of positions on a person. For example, the markers are located adjacent the various joints of the person which would move during a golf swing. In addition, a triad of reflective markers are mounted on a club shaft of a golf club which is to be swung by the person being analyzed. Typically, the person would stand on a pair of force plates 10 which are located at a predetermined location. The feet of the golfer are placed so that the vertical ground reaction forces of a golf swing can be sensed by the force plates 10 (see FIG. 3).

In addition, the recording and processing means includes a plurality of cameras 11 which are directed toward the location of the golfer from a plurality of different angles in order to record the 3D motions of the markers on the person and on the golf club during a golf swing. For example, four cameras 11 may be used, each being placed at the corner of a room in which the force plates 10 are located.

The recording and processing means also includes a motion analysis data acquisition system 12 that is connected to the cameras and, in particular, is connected to each camera to receive information corresponding to the position and motion of each marker viewed by the respective camera during a golf swing. A computer 13, such as a Sun Workstation (master controller) is connected to the data acquisition system 12 to control the process and to store and process the information to obtain data characteristic of the golf swing, i.e. marker path data (see FIG. 2).

The system also employs a force plate data acquisition system 14 for measuring and recording the vertical ground reaction forces of the person swinging the club between the golfer's feet and the ground during the swinging of the golf club (see FIG. 3). This system includes the two force plates 10 which use a cantilever beam configuration that senses loadings by linearly related deflections which in turn are sensed by strain gauges, a controlling computer 15 such as an IBM PC (slave controller) for storing and processing the force plate data, and a strain gauge data acquisition board (not shown) mounted inside the computer 15 to read and perform an analog to digital conversion of the strain gauge data from the force plates.

In addition, a synchronization circuit 16 is provided to allow the force plate data acquisition system 14 to be controlled by and synchronously run by the motion analysis system 12.

The motion analysis system 12 and the force plate data acquisition system 14 transfer their respective data via suitable lines to another computer 17, such as a Sun Workstation to create a computer model of a golf swing (see FIG. 8).

This second computer 17 includes a means (not shown) for generating a gender specific android model of a golfer (golfer model) which is configured as a three dimensional mechanism made up of rigid segments with mass, inertia, and size characteristics representative of a person selected from the group specified by gender, body weight, and overall height and spherical joints interconnecting the rigid segments, for example, as illustrated in FIG. 4. The computer 17 also serves to process the data received from the master controller computer 13 to calculate the three-dimensional angular motions for the android model segments and includes a means (not shown) for kinematically driving the joints of the android model of FIG. 4 in dependence on the angular motions to effect superposition of the golf swing on the android model in order to simulate the original golf swing.

The computer 17 also contains a means (not shown) for extracting the joint torque information derived from the analysis of the android model when the joints are driven kinematically and subsequently using this data to drive the joints kinetically also simulating the original swing.

The second computer 17 also includes a means (not shown) for generating a computer model of a golf club which is representative of the club swung by the golfer (FIG. 7*a*). The computer 17 also includes a means (not shown) for creating a complete model of a golfer from the android model and golf club model and adding a supporting ground surface for the android to stand upon (FIG. 8) and adding an optional impact model (FIG. 7*b*).

The second computer 17 also provides a means (not shown) for solving the model and post-processing the results.

The following describes the manner in which golfer, golf club, and golf swing data is obtained and processed in order to create a computer model of a golfer and simulate and analyze his or her swing.

Data Acquisition Phase

Actual golf swings are used to drive the computer model (FIG. 8) of the golf swing. These swings are recorded using the four camera Motion Analysis System (available from Motion Analysis Corp.) of FIG. 1 that collects marker position data at 180 Hz (1 of FIG. 5). This system tracks the reflective markers (not shown) that are strategically placed on the golfer and the club shaft. The markers are usually placed on the wrists, elbows, shoulders, hips, knees, ankles, feet, and upper and lower back of the golfer and a triad of rigidly configured markers is placed on the upper shaft of the golf club. This step generates the stick figure simulation of the golf swing as shown in FIG. 2. The stick figure simulation of the golf swing is also used to kinematically verify the model since the motions of each should be identical. Marker paths are processed to yield joint motions (3 of FIG. 5) which are used to kinematically drive the joints of the android (FIG. 4).

The force plates 10 measure the vertical reaction forces between each of the golfer's feet and the ground over a period of time corresponding to the time of the golf swing (see FIG. 3 and 1 of FIG. 5). The data obtained by the measurements is used for two purposes. First, the data provides kinetic verification of the model since ground reaction forces are one of the outputs of the analysis. The force plate data is summed then compared to the results generated by the model. For a kinematic analysis, the summation is necessary because the stiffness of the model can cause one foot to lose contact with the ground.

The second use of the force plates 10 is to cause the android to keep both feet on the ground. To this end, it is necessary to dynamically drive the Beta rotation (front to back) of one of the ankle joints to force the foot down while causing the associated foot of the model to mimic the ground reaction forces of the golfer. A torque control function (24 of FIG. 5) is used that incorporates the force plate data for the foot (19 of FIG. 5). The torque control function is given by Eqn (1);

$$T=\Sigma Ci\ (F_{meas}-F_{calc})^{Pi}+T\text{weight} \quad (1)$$

The function constants (Ci and Pi) are adjusted through trial solutions (20, 21, 24, and 25 of FIG. 5). Once an acceptable set of torque control function constants are found, the solution is iterated (21 and 25 of FIG. 5) until the individual ground reaction forces from the analysis match the force plate data.

The force plate data acquisition system 14 and the motion analysis system data acquisition system 12 are interfaced together through a sync circuit 16 with the motion analysis system acting as the supervisory controller and the force plate system acting as the slave controller. The motion analysis system controls the force plate system to collect data at the same rate and same start and stop times as it therefore the data from the two systems is in sync.

Computer Model of a Golfer

The commercial software package ADAMS/ANDROID is used to model the golfer. The "android" models a human as a complex three dimensional mechanism made up of fifteen rigid segments with mass and inertia properties (FIG. 4). The segments are connected with fourteen spherical joints that can be constrained or driven by separate motions and/or forces. Android models are gender specific and sized with population parameters (height and weight) that access GeBod data (ADAMS/ANDROID Users Manual) for representative segment size and mass and inertia properties. The ADAMS program performs the analysis of the model that the ADAMS/ANDROID module creates.

The marker path data from a golfer's swing, recorded with the motion analysis system, is processed to yield angular motions which are then used to drive the joints of the android. In this case, the joint kinematics are specified and the forces and torques at the golfers joints, at the grip, and on the ground necessary to produce the swing can be calculated (kinematic analysis). A kinematic analysis allows for the study of how changing golf club parameters will affect the golfer by the yielding changes in joint, grip, and ground forces and torques. The motion of the golfer's swing will not be altered although the performance of the golf club may be different.

If joint torques are used to drive the android, then the resulting joint motions can be determined (dynamic analysis). If the torques determined from a kinematic analysis are used to drive the android, then by Newton's Second Law the original swing is recreated (assuming the android and club parameters have not been changed). A dynamic analysis allows for study of how changes in the golf club affect the outcome of the swing. This is noted in changes in joint positions, velocities, and accelerations as well as possible changes in club performance. Unlike a human, the android will not adapt (unless instructed to) to new club configurations by altering joint forces and torques.

Thus, if a change in a golf club parameter affects the android's joint and/or interface forces and torques as determined by a kinematic analysis or joint and/or club motions as determined by a dynamic analysis, then the change will affect the golfer in some way. A kinematic analysis gives an indication of how a golfer might feel different club configurations whereas a dynamic analysis indicates how the swing may be affected. Also, if a change in a golf club parameter affects the club performance in some way, it will be revealed as changes in deflections and oscillations of the shaft, position and orientation of the club head, and response to impact and will be evident in both a kinematic and dynamic analysis.

Both types of analysis yield considerable insight into the biomechanics of a golf swing. The analysis allows for the study of the kinematics and kinetics of the body and body segments involved in producing a golf swing for an individual golfer as well as the factors that influence the body in producing a golf shot.

In order to kinematically drive the joints of the android, the 3D marker path data is processed to yield joint and club angular positions as a function of time in spline format. Calculation of joint angles from marker paths is described below:

The android is kinematically driven by specifying the relative body 1-2-3 Euler angles (Bryant angles Alpha, Beta, and Gamma) for each joint. To determine the angles, local coordinate systems are defined for each segment from groups of three adjacent marker locations and are represented in matrix form (left side of Eqn (2)). This is set equal to the Bryant angle transformation matrix:

$$\begin{bmatrix} Xx & Yx & Zx \\ Xy & Yy & Zy \\ Xz & Yz & Zz \end{bmatrix} = \begin{bmatrix} C2C3 & -C2C3 & S2 \\ S1S2C3 + C1S3 & -S1S2S3 + C1C3 & -S1C2 \\ -C2S2C3 + S2S3 & C1S2S3 + S1C3 & C1C2 \end{bmatrix} \quad (2)$$

where Ci=Cos (i), Si=Sin (i), and 1, 2 and 3 correspond to Alpha, Beta, and Gamma rotations respectively. The global Bryant angles can be obtained by extracting the following relationships from Eqn (2) from element by element equalities:

$$Zy = -S1C2 \quad (3)$$

$$Zz = C1C2 \quad (4)$$

Dividing Eqn (3) by Eqn (4) yields the formula for Alpha:

$$\text{Alpha} = \text{Tan}^{-1}(Zy/Zz) \quad (5)$$

Using a similar procedure, the expressions for Beta and Gamma are found:

$$\text{Beta} = \text{Tan}^{-1}(Zx/(Zy^2+Zz^2)^{1/2}) \quad (6)$$

$$\text{Gamma} = \text{Tan}^{-1}(-Yx/Xx) \quad (7)$$

Determination of the relative Bryant angles is done the following way: The relationship between the rotation matrices of adjacent segments is given by:

$${}_{D}^{G}R = {}_{P}^{G}R\ {}_{D}^{P}R \quad (8)$$

where G is ground (global reference system), D is the distal segment, and P is the proximal segment. The form of the rotation matrices in Eqn (8) are in the same as given by Eqn (2). The relative Bryant angles are contained inside of the $${}_{D}^{P}R$$

matrix. In order to isolate this matrix, both sides of Eqn (8) are multiplied by the inverse of the $${}_{P}^{G}R$$

matrix yielding:

$$[{}_{P}^{G}R]^{-1}\ {}_{D}^{G}R = {}_{D}^{P}R \quad (9)$$

The global Bryant angles are substituted into the $${}_{D}^{G}R \text{ and } {}_{P}^{G}R$$

matrices. The relative Bryant angles are then extracted from the $${}_{D}^{P}R$$

matrix in a manner similar to that used for the global Bryant angles.

Referring to FIG. 5, there are three generic files that are processed in order to create the android model of the golfer. They are Golfer.prp, Golfer.int, and Golfer.and.

The Golfer.prp file contains all the spline information to drive the joints of the android. The main FORTRAN program (Golfer.f) processes the motion analysis 3D marker path data to determine the joint angles (kinematic analysis) or extract the joint torques (dynamic analysis) (2, 3, 4, 23) and inserts the data into the Golfer.prp file to create a file called "Name".prp where "Name" is the golfer to be analyzed (5).

Next, the Golfer.f program creates a file "Name".and from the file Golfer.and which takes the first angular position spline data point for each joint to establish the initial position of the android (7).

Finally, the file "Name".int file is created from the generic file Golfer.int to establish the initial orientation and position of the golfer relative to the golf club (6).

Golf Club Model

The next step is to create the model of the golf club. The dynamic quantities needed to create the golf club model include material properties, mass, mass center location and inertia tensor of the shaft and club head plus the length, flexibility and damping of the shaft.

A combination of experimental, analytical, and computer techniques are utilized to determine the club dynamic properties. Solid modeling is used to determine the mass properties of the shaft and iron club heads and is described below (12). (Mass properties refers to mass, mass center location, and inertia tensor.) The mass properties of driver club heads are obtained from published data and are usually determined using an inertia pendulum (11). The flexibility parameters for the shaft are determined using standard analytical techniques (10). The damping coefficient of the shaft is determined using standard experimental techniques (9).

A detailed solid model representation of an iron golf club head is used to extract accurate mass properties necessary for the dynamic model of a golf club (12). For example, using a software package such as an ANSYS (Swanson Analysis Systems, Inc. Version 4.4a), a solid model comprised of finely meshed elements yields this information, for example a Ben Hogan 6 iron (FIG. 6). However, the modeling of individual iron golf club heads is a tedious task. Therefore, a parametric iron golf club head model was created through the integration of a FORTRAN program and ANSYS to facilitate the modeling of existing and modified golf club head configurations.

In the parametric model, all significant features of the iron golf club head are designed as variables so solid models can be created easily. The interactive FORTRAN program prompts the user for material properties, geometric quantities, and mesh sizes (8). User inputs are converted into critical locations on the club head using geometric equations. The FORTRAN program then creates the ANSYS data set that is directly loaded into the ANSYS program to create the solid model. The solid model is partially solved to yield the mass properties of the club head.

Solid modeling is the primary method used to determine the mass properties of the shaft although standard analytical methods can be used as well (12). A FORTRAN program accepts as inputs the critical dimensions and material properties of the shaft (8). An ANSYS data file is created, loaded, and processed to yield the mass properties of the shaft.

Once obtained, the dynamic quantities of the entire golf club are entered into a FORTRAN program called "club.f" (13) which creates the ADAMS file "club.adm" (15). The "club.adm" file is loaded into the ADAMS program to create the dynamic club model (FIG. 7*a*) (16). The "club.f" program uses the initial angular position of the marker triad placed on the golf club shaft to establish the initial position of the club. This file also contains the ground surface for the android to stand on and an acceleration vector (not shown) to simulate a gravitational load on the android and the club.

The "club.adm" file allows for an impact model of a golf club head striking a golf ball (26) to be added to study the effects of impact on the golfer and golf shot and the behavior of the club. Referring to FIG. 7*b*, the impact model contains a graphical and dynamic representation of a ball and several coordinate triads indicating important locations in the club and impact models plus three forces; one for supporting the ball model and releasing it at impact as would a golf tee, one for simulating an impact through the club head mass center, and one for simulating an additional torque caused by an impact not through the mass center (eccentric impact). The impact forces are modeled as spring-damper systems. As such, the following coefficients must be entered; spring free length, spring rate and exponent, damping coefficient, and damping depth. These are obtained from published data.

The "club.adm" file is processed by the ADAMS program to produce an environment file "club.env" (17) for combination with the android.

The three files, "Name.prp", "Name.int", and "Name.and", plus the "club.env" file are combined in the android preprocessor (18). The golfer's height, weight and gender are entered and the complete model of the golfer is created (FIG. 8) (20). The procedure is as follows: First, the club is positioned and oriented relative to the global coordinate system using initial data from the motion analysis system. Next, the android and club are combined with the android positioned and oriented relative to the club. The android does not come with hands and therefore does not possess wrist joints. These are created by joining the club and android with spherical type joints placed at the ends of the lower arms. Generally, the linear degrees of freedom (DOF's) of the joint are rigid for one arm and flexible for the other because of the rigid nature of the android does not allow for looped structures. The angular DOF's are either kinematically or dynamically driven to simulate the motions or torques of the wrist. Finally, the ground surface is added and positioned into place by sight. A spring-damper models the contact between the ground and the android's feet.

The android is balanced for both a kinematic and dynamic analysis by kinematically driving the angular DOF's of its lower torso segment relative to the global coordinate system. To avoid over constraining the model, the linear DOF's are set free. This balances the android but can cause one of the feet to lose contact with the ground if the joints are driven kinematically. The problem is solved with the force plate data as was described previously. Each remaining segment is driven relative to its adjacent distal element.

Solution of the Model

Once the android, club, and ground surface have been combined, the complete model is ready for solution by the ADAMS program (21). Both a kinematic and a dynamic analysis require a dynamic solution methodology (integration) because of the flexible shaft, spring-damper surface contact, and the spring-damper impact model. The ability of ADAMS to solve the model depends heavily upon the values used for the torque control function constants, solution error tolerances, surface contact coefficients, impact model constants, and the initial position of the surface relative to the android's feet. These parameters can be adjusted to facilitate solution without compromising the results of the analysis. Considerable smoothing of the marker path data is required to yield good results.

The model is verified kinematically by comparing the simulated swing performed by the model with the stick figure representation of the swing as generated by the motion analysis system. The model is verified kinetically by comparing the summation of the vertical reaction forces as measured by the force plate data acquisition system with the summation of the vertical ground reaction forces as determined by a kinematic analysis of the model prior to adding the torque control function (see FIG. 3).

Uses and Outputs of the Model

The model is used to study the biomechanics of a golfer, determine the performance of his or her equipment, and quantify the effects of changing golf club parameters on the golfer, his/her swing, and the equipment. Because the golfer is included in the model, it is possible to determine how club changes may affect different golfers in terms of body style, level of play and swing characteristics. The analysis yields a wealth of information including but not limited to the following:

animation of the swing (FIGS. 9*a*–9*d*)

interactions between golfer, equipment and ground (FIGS. 3, 10*a*, and 10*b*)

kinematics and kinetics of each joint (FIGS. 11*a* and 11*b*)

position of mass center of the golfer (FIG. 12)

position and orientation of the club head (FIG. 13)

club deflections (FIG. 14)

club behavior to impact (FIG. 15)

By way of example, FIGS. 9*a* and 9*b* indicate different positions of the complete android and golf club model at different times during a simulated golf swing. That is, FIG. 9*a* illustrates the simulating golf swing at the beginning of the back swing while FIG. 9*b* illustrates the golf swing at a mid-point during the down swing. FIG. 9*c* graphically illustrates a simulated golf swing showing the path of the and club head with the android graphics removed for clarity. FIG. 9C also indicates the path at the golfer's hands (not shown) at the gripped end of the golf club. FIG. 9*d* graphically illustrates a side view of a simulated golf swing to show the path of the club head as well as the not shown hands of the golfer with the android graphics removed for clarity.

FIG. 10*a* graphically illustrates the swing, pitch, and roll angular velocity components in degrees per second of a golf club during a swing where swing refers to angular motion in the plane of the swing, pitch refers to angular motion of the swing plane about a horizontal axis, and roll refers to angular motion about the long axis of the shaft. As indicated, the angular velocity is plotted against time in seconds and are illustrated by the three indicated lines.

FIG. 10*b* illustrates the torque supplied by the golfer to the golf club during a swing. As indicated, the torque in inch pounds is plotted against time in seconds. In particular, the swing, pitch and roll components of the torque are illustrated by the three indicated lines.

FIG. 11*a* graphically illustrates the angular velocity kinematics of a joint, for example, the left shoulder joint, of the android model. The angular velocity is calculated in radians per second against time in seconds. The three illustrated curves represent the Alpha, Beta and Gamma components of angular velocity were Alpha represents lateral motion, Beta represents front and back motion, and Gamma represents motion about the long axis of a segment.

FIG. 11*b* graphically illustrates the torque kinetics of the mid-back (thoracic) joint of the android model. The torque is measured in inch pounds against time in seconds. In particular, the Alpha, Beta and Gamma components of the torque are illustrated by the three indicated lines.

FIG. 12 illustrates the path of the mass center of the android model while simulating a swing. In this regard, the position is measured in inches against time in seconds. The three coordinates X, Y, Z of the center of gravity are indicated by the three curves.

FIG. 13 graphically illustrates the position and orientation of the club head during a simulated golf swing relative to a golf ball model.

FIG. 14 illustrates the magnitude of the deflection of the club head mass center relative to the club head mass center of the same club with a rigid shaft during a golf swing. As indicated, the deflection is measured in inches against time in seconds. The figure illustrates the storing of energy in the shaft during the downswing (negative time), the release of this energy near impact (0.0 sec), and the deflection of the shaft during deceleration in the follow through (positive time). The figure indicates that not all of the stored energy was released at the time of impact. Using another club configuration and/or possibly altering the golfer's swing may correct this.

FIG. 15 illustrates the club head deflection caused by the swinging of the club and impact with the ball of FIG. 7*b*. The deflection is measured in inches against time in seconds. Further, the illustrated deflection is for an eccentric impact, i.e. for an impact spaced from the "sweet spot" that occurs just before 0.0 seconds. The curve has the same general shape as FIG. 14 during the downswing. The additional deflection caused by impact and the change in the deflection in the follow through are quite evident.

The invention thus provides for a comprehensive biomechanical and dynamic analysis of a golfer and his equipment. As such, it becomes a tool for studying the golfer and the interactions with his equipment as well as the effects that changing equipment has on the golfer, his swing, and the behavior of the equipment.

The invention can be used to determine where stresses are placed on the joints of a golfer during a golf swing with a particular club or clubs. In this regard, if one determines that excessive stress is being placed in a particular joint, the golfer can be trained to change his golf swing so as to avoid or minimize this stress and/or select or design different golf clubs so to avoid or minimize this stress while achieving an effective swing.

In addition, the invention allows an analysis of the effects of a golf club on the performance of a golfer. To this end, the golf club can be changed or be designed so as to accommodate or "match" the appropriate club with the unique style of swing and playing ability of the golfer and/or select or design golf clubs to alter some aspect of a golfer's swing.

The information obtained for the invention allows for the study of what happens kinematically and kinetically inside a golfer in producing a golf shot. This information can be used to define what constitutes the most efficient swing for a given body type, age, and gender. As such, the information becomes a tool for coaching and instruction.

The information from the invention provides a means for determining the behavior of golf equipment when subjected to a particular golfer's swing and impact. Thus, the invention becomes a tool for the design and selection of golf equipment.

The method provides kinematic and kinetic information about every joint in the golfer's body. This information will assist in determining why and how a golfer injuries themselves.

The same information identifies where in a golfer's body the power for producing a swing comes from. This can be used to develop training programs to improve a golfer's strength and flexibility in ways to enhance their performance.

It is to be noted that the method and apparatus for analyzing a swing may also be employed in other environments such as for analyzing the swing of a baseball player, tennis player or similar situations where human motion is involved or affected by the movement of an implement such as riding a bicycle or lifting weights.

What is claimed is:

1. A method of analyzing a golfer and a golf swing comprising the steps of generating a three-dimensional android model having rigid segments with characteristics representative of a human person and spherical joints interconnecting said rigid segments;

generating a parametric dynamic model of a golf club representative of a club;

combining said android model with said golf club model and a ground surface model to create a complete model;

placing a plurality of markers on a person;

placing a triad of markers on a golf club shaft of a golf club;

recording and processing the motion of said markers on said person and on said club shaft in three dimensions during swinging of said club by said person to obtain marker path data characteristics of the golf swing;

processing said marker path data to calculate three dimensional angular motions for said android model segments and said dynamic golf club model corresponding to said marker path data; and kinematically driving said joints of said android model in dependence on said three-dimensional angular motions to effect superposition of said golf swing on said android model and said golf club model.

2. A method as set forth in claim 1 which further comprises the steps of recording at least one of the characteristics of overall height, body weight and gender of said person, and wherein said characteristics of said person are used to select from a data set representative of the general population at least one characteristic consisting of gender, segment size, mass and inertia properties in generating said android model representative of said person.

3. A method as set forth in claim 1 wherein said golf club model is moved with said android model in dependence on said marker path data to mimic said golf swing.

4. A method as set forth in claim 1 wherein said android model is balanced on said ground surface model in dependence on said marker path data to mimic the stance and motions of said person.

5. A method as set forth in claim 4 which further comprises the steps of recording vertical ground reaction forces of said person; and superimposing a torque control function on said kinematically driven joints of said android model to maintain both feet of said android model on a ground surface in dependence on said recorded ground reaction forces.

6. A method as set forth in claim 1 which further comprises the step of analyzing said complete model to determine the effect of a recorded person's swing in at least one of (a) said joints of said android model, (b) an interface between said android model and said club model, (c) an interface between said android model and said ground surface model and (d) the dynamic performance of said club.

7. A method as set forth in claim 1 which further comprising the steps of kinematically analyzing the movements of said android model to determine the torque in each joint thereof; and thereafter driving at least one of said joints of said android model in dependence on said torques to recreate the original golf swing.

8. A method as set forth in claim 1 which further comprises the steps of altering dynamic parameters of said golf club model to determine the effects of altered club configurations on at least one of (a) the joints of said android model, (b) an interface between said android model and said club model, (c) an interface between said android model and said ground surface model, and (d) the dynamic performance of the club.

9. A method as set forth in claim 1 which further comprises the step of adding an impact between said club model at a club head and a ball model to determine the effects on at least one of (a) said joints of said android model, (b) said interface between said android model and said club model, (c) said interface between said android model and said ground surface model, and (d) the dynamic performance of the club.

10. A system for analyzing a golf swing of a golfer comprising means for generating a three-dimensional android computer model having rigid segments with characteristics representative of a person and spherical joints interconnecting said rigid segments;

means for generating a parametric dynamic computer model of a golf club representative of a golf club to be swung by a person;

means for combining said android model with said golf club model and a ground surface model;

means for recording and processing the motion of a person in three dimensions during swinging of a golf club to obtain data characteristic of the swing;

a first computer for processing said data to calculate three-dimensional angular motions for said android model segments and said golf club model corresponding to said data;

means for kinematically driving said joints of said android model in dependence on said angular motions to effect superposition of said golf swing on said android model and said golf club model; and means for extracting joint torques from the analysis of the kinematically driven joints of said android model and dynamically driving said android joints in dependence with said torques to effect superposition of said golf swing on said android model and said golf club model.

11. A system as set forth in claim 10 wherein said means for recording and processing the motion of a person includes a plurality of cameras directed toward the person from a plurality of different angles for recording the motions of a plurality of markers on the person and a triad of markers on the golf club during a golf swing.

12. A system as set forth in claim 11 wherein said means for recording and processing the motion of a person further includes a data acquisition system connected to each said camera to receive information therefrom corresponding to the motion of said markers and a second computer connected to said data acquisition system to receive and process said information to obtain said data characteristic of the swing.

* * * * *

UNITED STATES PATENT AND TRADEMARK OFFICE

CERTIFICATE OF CORRECTION

PATENT NO. : 5,772,522

DATED : June 30, 1998

INVENTOR(S) : Steven M. Nesbit, et al.

It is certified that error appears in the above-identified patent and that said Letters Patent is hereby corrected as shown below:

On the Title Page, Item [73] Assignee, change "United States of Golf Association" to --United States Golf Association--

Signed and Sealed this

Fifteenth Day of May, 2001

*Attest:*

Nicholas P. Godici

NICHOLAS P. GODICI

*Attesting Officer*

*Acting Director of the United States Patent and Trademark Office*